United States Patent [19]

Hass et al.

[11] Patent Number: 4,940,425

[45] Date of Patent: Jul. 10, 1990

[54] ELECTRICAL CONTACT MEMBER

[75] Inventors: Juergen Hass, Erzhausen; Gheorghe Hotea, Griesheim, both of Fed. Rep. of Germany

[73] Assignee: AMP Incorporated, Harrisburg, Pa.

[21] Appl. No.: 385,609

[22] Filed: Jul. 25, 1989

[30] Foreign Application Priority Data

Jul. 26, 1988 [GB] United Kingdom ..... 8817783

[51] Int. Cl.[5] ..... H01R 4/24

[52] U.S. Cl. ..... 439/397; 439/406; 439/407

[58] Field of Search ..... 439/389–407

[56] References Cited

U.S. PATENT DOCUMENTS

| | | | |
|---|---|---|---|
| 3,867,005 | 2/1975 | Hoppe, Jr. | 339/98 |
| 3,993,391 | 11/1976 | Vernerey et al. | 339/97 |
| 4,040,702 | 8/1977 | McKee et al. | 439/407 |
| 4,050,760 | 9/1977 | Cohen | 439/407 |
| 4,125,311 | 11/1978 | Hoppe, Jr. | 439/406 |
| 4,264,118 | 4/1981 | Nijman | 339/97 |
| 4,346,955 | 8/1982 | Chesnais et al. | 439/407 |
| 4,480,385 | 11/1984 | Dragisic | 29/866 |

FOREIGN PATENT DOCUMENTS 8615615 9/1986 Fed. Rep. of Germany .

*Primary Examiner*—David Pirlot

*Attorney, Agent, or Firm*—Bruce Wolstoncroft; Eric Groen

[57] ABSTRACT

The contact member defines a channel having a base from which project side walls bowed in portions of which define wire slots. Inwardly convergent wings surmounting each wire slot have insulation severing edges. When a lead is forced into the channel the edges sever the insulation of the lead so that the crests of the bowed portions engage the core of the lead. The wings are then bent across the channel to hold the lead down therein. The portions merge with dimples in the base so that the side walls and the base are continuous as seen in cross section through the wire slots, so that the rigidity of the contact member and the contact force exerted against the core, are improved.

7 Claims, 4 Drawing Sheets

Fig. 1
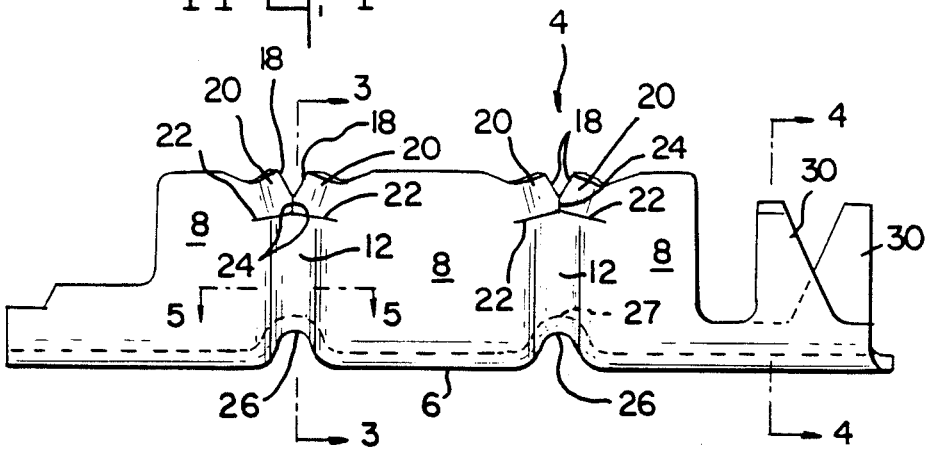
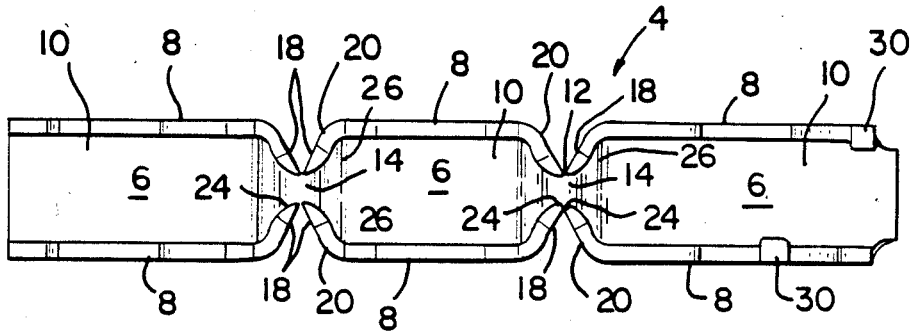
Fig. 2
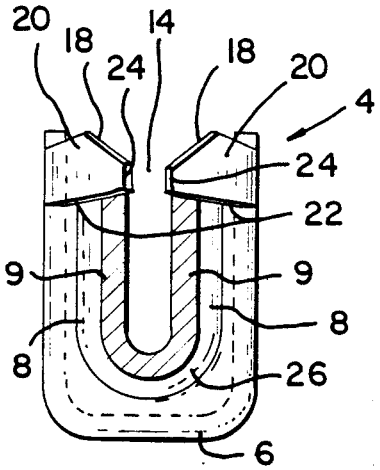
Fig. 3
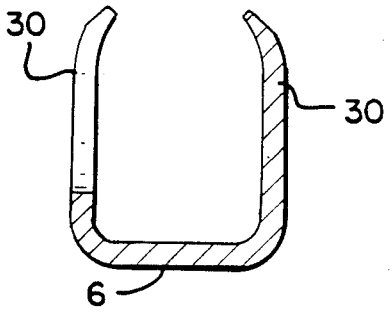
Fig. 4

Fig. 6
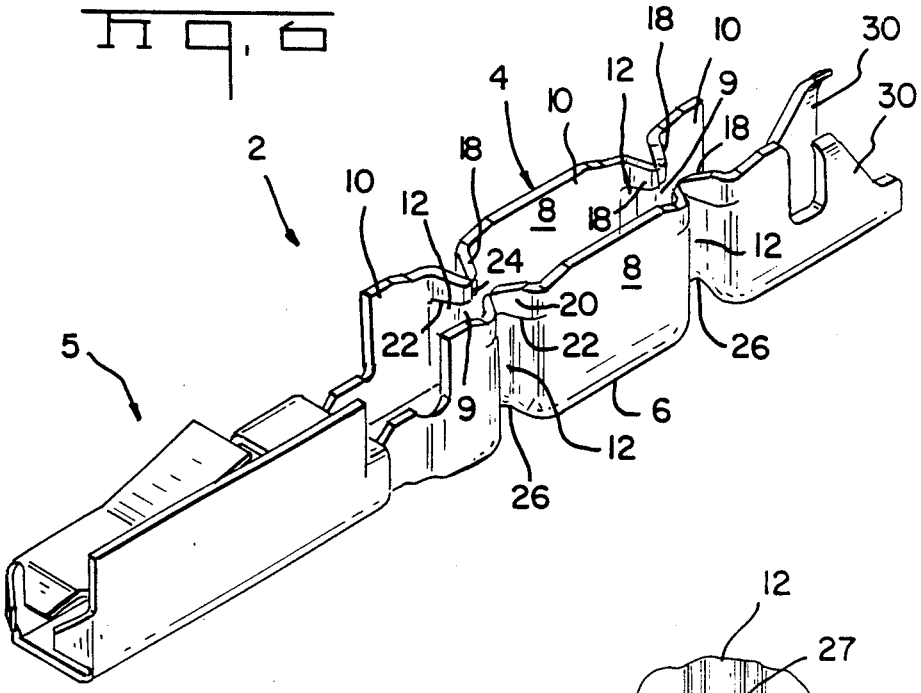
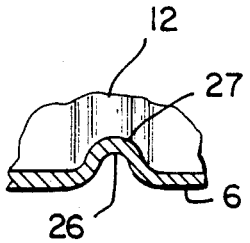
Fig. 7
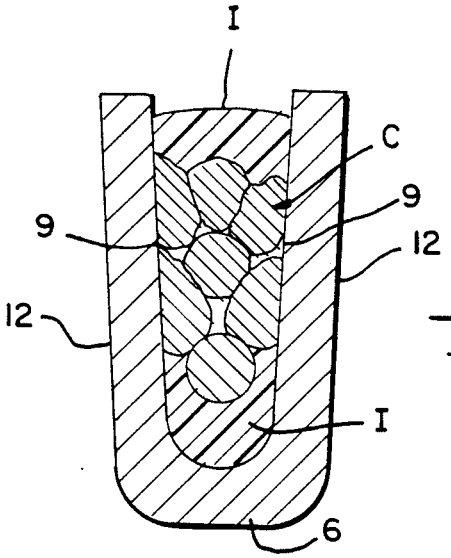
Fig. 9

ELECTRICAL CONTACT MEMBER

BACKGROUND OF THE INVENTION

1. Field of the Invention

This invention relates to an electrical contact member for making permanent electrical contact with the metal core of an insulated electrical lead.

2. Description of the Prior Art

There is described in U.S. Pat. No. 3,867,005, a one-piece stamped and formed electrical contact member for making permanent electrical contact with the metal core of an insulated electrical lead, the contact member, which is of substantially U-shaped cross section, comprising a base and spaced side walls extending in the same direction, each from an opposite edge of the base, to define a lead-receiving channel, opposed portions of the side walls being bowed towards each other inwardly of the channel, to define a core receiving slot extending substantially normally of said base, and each bowed portion being surmounted by a pair of insulation severing surfaces converging towards each other inwardly of the channel and being inclined towards the base.

According to U.S. Pat. No. 3,867,005, the insulation severing surfaces of each bowed portion are defined by a V-shaped notch in that edge of the bowed portion which is remote from the base.

The metal core of the lead is electrically connected to the contact member, by forcing it down into the channel by means of application tooling, so that the insulation severing surfaces of each bowed portion cooperate to sever the insulation of the lead as it is being forced into the channel, whereby the crests of the bowed portions make electrically conductive contact with the core of the lead.

SUMMARY OF THE INVENTION

It is an object of the invention to ensure that once the lead has been forced down into the channel as described above, it cannot ride up therein so as to impair the integrity of the electrical connection between said crests and the metal core.

According to the present invention, each insulation severing surface of said pair of insulation severing surfaces of each bowed portion is defined by a lead hold down wing extending from the respective side wall and being divided from said inwardly bowed portion, the wings of said pair converging from said side wall towards the center line of the channel and being plastically deformable relative to said inwardly bowed portion, away from each other into substantially parallel relationship to lie athwart the channel.

When the lead is being forced into the channel, the application tooling is caused to bend the wings of each pair away from each other after the core has been received in said lead-receiving slot, so that the wings engage over the insulation of the lead and so hold it down in the channel at positions closely proximate to the electrical connection between the crests of the bowed portions and the metal core of the lead, and on each side of that connection.

Although U.S. Pat. No. 4,480,385 discloses the step of shearing out segments of the side walls of the contact member to hold the lead down in the channel such an expedient must impair the rigidity of the contact member when the lead has been terminated thereto and the lead is held down only on one side of the electrical connection and at a substantial distance therefrom.

Preferably, as seen in cross section through the bowed portions, the side walls and the base are continuous, the base also being bowed inwardly, so that a continuous, smoothly arcuate dimple extends about the periphery of the contact member up to said wings. Since the inwardly bowed portions of the side walls are undivided from the base, the rigidity of the contact member is greatly improved as well as the contact force exerted by the inwardly bowed parts of the side walls against the metal core of the lead, especially where the core is multistranded.

Flanges may be struck inwardly from the side walls, at opposite positions there along, to provide one or more auxiliary core-receiving slots, such flanges may be provided between two pairs of inwardly bowed portions, spaced from one another lengthwise of the channel and may be formed with insulation severing surfaces.

BRIEF DESCRIPTION OF THE DRAWINGS

FIG. 1 is a side view of an electrical contact member of an electrical terminal.

FIG. 2 is a top plan view of the contact member.

FIG. 3 is an enlarged view taken on the lines 3—3 of FIG. 1.

FIG. 4 is an enlarged view taken on the lines 4—4 of FIG. 4.

FIG. 5 is a view taken on the lines 5—5 of FIG. 1.

FIG. 6 is an isometric view of the terminal, including its contact member.

FIG. 9 is an enlarged cross-sectional view taken on the lines 9—9 of FIG. 7, and which was prepared from a section photograph of an actual terminal according to FIG. 7.

DETAILED DESCRIPTION OF THE PREFERRED EMBODIMENT

Figure 7:
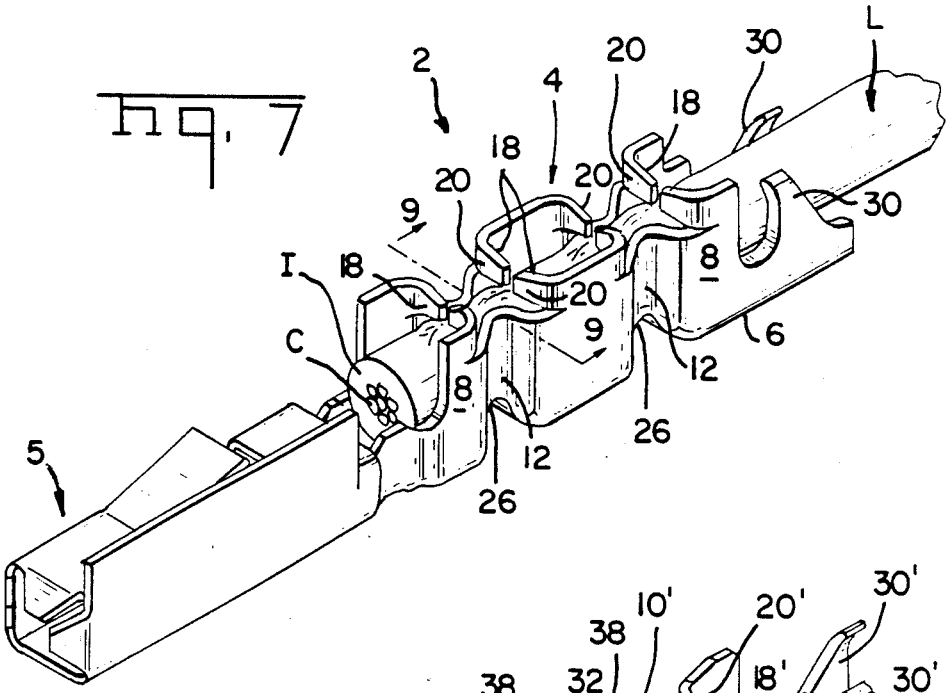
FIG. 7 is an isometric view showing the terminal when it has been terminated to an electrical lead.

An electrical terminal 2, shown in FIGS. 6 and 7, and which has been stamped and formed from a single piece of sheet metal stock, comprises an electrical contact member 4 for making permanent electrical contact with the metal core of an insulated electrical lead, and a mating portion 5 for receiving a male contact element (not shown). In practice, the portion 5 receives a spring metal receptacle, which is not shown, for making resilient electrical contact with the male element. The receptacle is not, of course, formed integrally with the terminal shown but is inserted into the portion 5.

The contact member 4 is, as best seen in FIGS. 3 and 6, of substantially U-shaped cross section, comprising a base 6 and spaced side walls 8 extending in the same direction, each from an opposite edge of the base 6, to define a lead-receiving channel 10. Opposed portions 12 of the side walls 8 are bowed towards one another, in smoothly arcuate fashion, inwardly of the channel 10 at two positions there along, so as to have opposed crests 9, the crests 9 of each pair of opposed side wall portions 12 define a lead core receiving slot 14 extending substantially normally of the base 6. Each bowed portion 12 is surmounted by a pair of insulation severing edge surfaces 18 which converge towards each other inwardly of the channel 10 and are inclined towards the base 6.

Each insulation severing surface 18 is formed on a respective lead hold down wing 20 extending from the respective side wall 8, each wing 20 being divided from the respective inwardly bowed portion 12 by a slit 22, the slits 22 being substantially coextensive with the arcuate periphery of the bowed portion 12. The wings 20 of the pair of wings 20 surmounting each bowed portion 12 converge towards one another from said respective side wall 8 towards the center line C of the channel 10 and are plastically deformable away from each other into substantially parallel relationship to lie athwart the channel 10. The wings 20 of each pair, have juxtaposed free ends 24, which are of rectangular shape and lie in contiguous relationship, or at least closely adjacent to one another. The slits 22 dividing the wings 20 from each bowed portion 12 are substantially coterminous with its free edge. The portions 12 of each pair of opposed portions 12 merge with an arcuate dimple 26 formed in the base 6 of the contact member 4 and having a crest 27, so that as seen in cross section through a pair of opposed bowed portions 12, as shown in FIG. 3, the cross section of the contact member 4 is smoothly U-shaped and is continuous between the slits 22.

Beyond the side walls 8, in a direction away from the mating portion 5, insulation embracing lugs 30 which are offset from one another lengthwise of the center line C, extend from the side walls 8.

In order to terminate an insulated electrical lead L (FIG. 7) having insulation I and a multistranded metal core C, to the terminal 2, tooling, not shown, is applied to force the lead L down in a direction at right angles to its longitudinal axis, into the channel 10 and between the lugs 30 to drive the lead core C into the slots 14. As the core C is being forced down into the slots 14, the insulation severing surfaces 18, cut through the insulation I of the lead L on opposite sides thereof so that as the core C enters the wire slots 18, the opposed crests 9 of the bowed portions 12 of each pair enter the incisions made in the insulation I by the surfaces 18, so as tightly to engage the core C between the crests 9. When the lead L has been forced home, down against the base 6, the tooling forces the wings 20 of each pair apart from one another so as to extend athwart the channel 10, as shown in FIG. 7, so that the wings 20 of each pair lie in substantially parallel relationship, whereby the lead L is permanently held down in the channel 10 so that core C cannot ride up in the slots 14. As will be apparent from FIG. 9, the crests 9 of the bowed portions 12 associated with each slot 14 compress between them, the strands of the core C so that a minimal resistance electrical connection is achieved between the core C and the terminal 2. As shown in FIG. 9, the contact force exerted by the bowed portions 12 is great enough plastically to deform the strands so that what is in effect a cold forged connection is produced between the core C and the contact member 4. The tooling also crimps the lugs 30 about the insulation I of the lead L to provide strain relief for the connections between the core C and the contact member 4.

Figure 8:
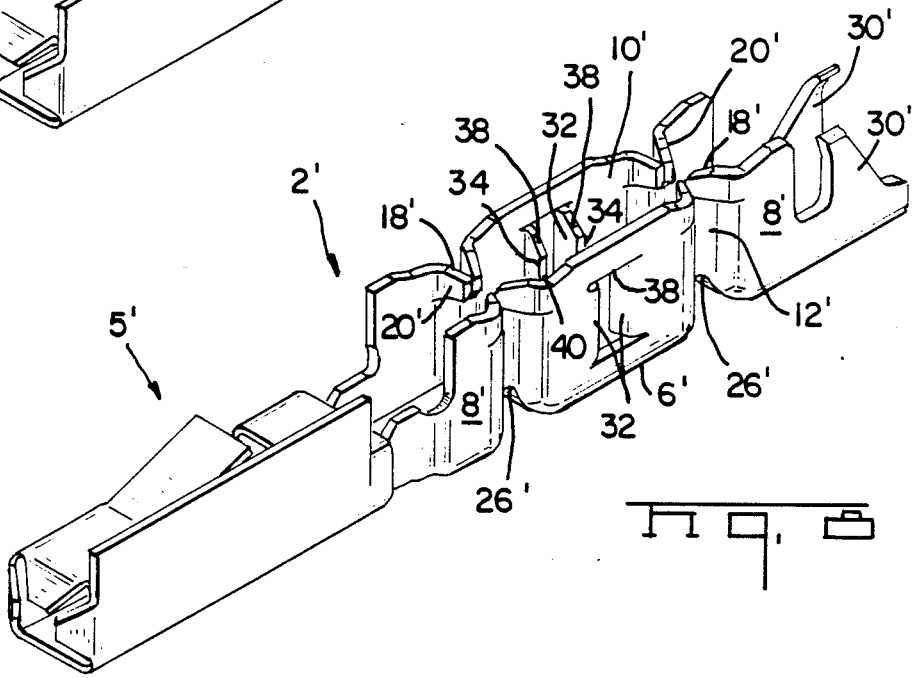
FIG. 8 is an isometric view of a modified version of the terminal.

Reference will now be made to FIG. 8, in which those parts which are the same as corresponding parts described above with reference to FIGS. 1 to 7 and 9 bear the same reference numerals, with the addition of a prime symbol. According to the modification of FIG. 8, the side walls 8' have struck inwardly therefrom, substantially mid-way between the pairs of opposed bowed portions 12', flanges 32, opposed pairs of which extend towards one another across the channel 10' to define auxiliary core-receiving slots 34. Each flange 32 is formed at a position remote from the base 6', with an insulation severing surface 38, the surfaces 38 of the flanges 32 of each pair of opposed flanges 32, converging in the direction of the base 6', and the slots 34 being defined by core gripping edge surfaces 40 each extending from a respective edge surface 38, substantially normally of the base 6' so that the surfaces 40 are substantially parallel with each other. When a lead L is forced into the channel 10' in the manner described above with reference to FIG. 7 in relation to the channel 10, the surfaces 48 of the flanges 32 sever the insulation I of the lead L so that the surfaces 40 defining the slots 34 engage the core C of the lead L, thereby to augment the electrical connection between the core C and the contact member 4'.

Figures 10, 11:
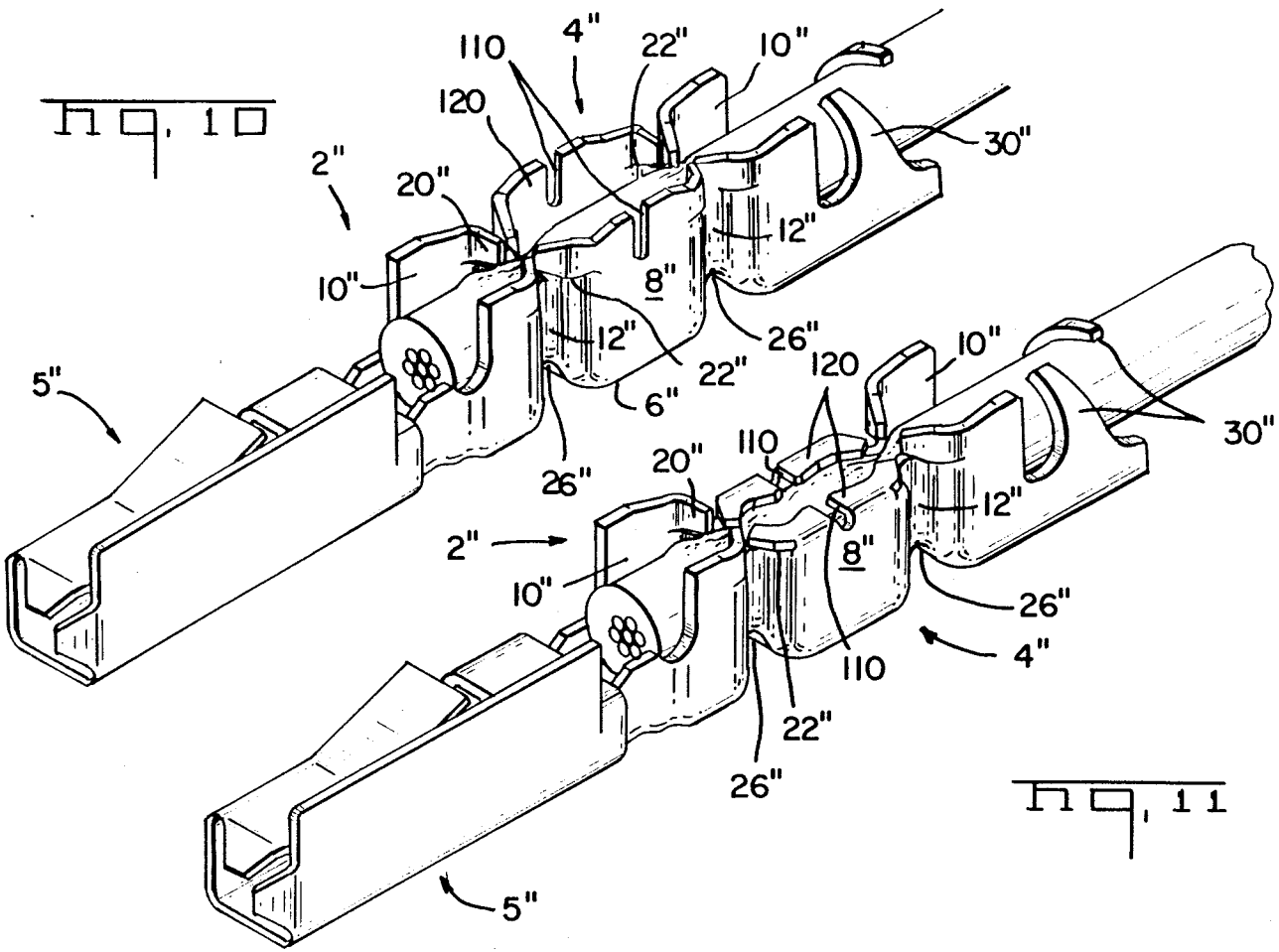
FIG. 10 is an alternate embodiment of electrical terminal showing the wire retaining means prior to final retained position.
FIG. 11 is a view similar to FIG. 10 showing the wire retaining means in the final position.

Reference will now be made with reference to FIGS. 10 and 11, in which those parts which are the same as corresponding parts described above with reference to FIGS. 1 to 7, 8 and 9 bear the same reference numerals, with the addition of a double prime symbol. The terminal 2" includes similar wings 20 which provide insulation displacement connection with the core C of an insulated conductor. Rather than moving the wings 20 as in previous embodiments, such that lower edges of the wings are over the top of the insulated wire to retain the wire in place, the terminal 2" includes inner wings 20" which are integral with a flap member 120 which is bendable about an axis parallel to the length of the wire. The flaps 120 are severed about their midpoint at 110 so as to allow the flaps to act independently of one another and to prevent any buildup of stress into the midpoint of the flaps 120 during the bending process.

Advantageously, all of the above mentioned embodiments utilize at least one pair of opposed wings which sever the insulation from the electrical lead L during the transverse movement of the lead into the slot, with continued movement of the lead causing electrical termination within the bowed portions 12, 12' or 12". Once the insulated wire is into electrical engagement within the bowed section 12, 12' or 12", the wire severing aspect of the wings is no longer needed and therefor can be moved relative to the bowed sections to retain the insulated lead in place. In the embodiments shown in FIGS. 6 and 8, the wings are moved about an axis which is perpendicular to the length of the lead, whereas in the embodiment of FIG. 10, the wings are integral with flap portions 120 which are bendable about an axis which is parallel to the length of the lead L.

We claim:

1. A one-piece stamped and formed electrical contact member for making permanent electrical contact with the metal core of an insulated electrical lead, the contact member, which is of substantially U-shaped cross section, comprising a base and spaced side walls extending in the same direction, each from an opposite edge of the base to define a lead receiving channel, opposed portions of the side walls being bowed towards each other inwardly of the channel to define a core-receiving slot extending substantially normally of said base, and each bowed portion being surmounted by a pair of insulation severing surfaces converging towards each other inwardly of the channel and being inclined towards the base; characterized in that each insulation severing surface of said pair of insulation severing surfaces of each bowed portion is defined by a lead hold-down wing extending from the respective side wall and being divided from said inwardly bowed portion, the wings of said pair converging from said side wall towards the center line of the channel and being plastically deformable relative to said inwardly bowed portion to overlie the electrical lead.

2. The contact member of claim 1 characterized in that the wings are deformable about an axis which is perpendicular to the base, and away from each other into substantially parallel relationship so as to lie athwart the channel.

3. The contact member according to claim 1 characterized in that the wings are integral with a flap which is bendable about an axis parallel to the length of the electrical lead to overlie the lead.

4. A contact member according to claim 1, characterized in that the wings surmounting each bowed portion, which define a V as seen in top plan view, and have closely adjacent or contiguous free ends.

5. A contact member according to claim 1, characterized in that the wings surmounting each bowed portion are divided therefrom by slits which are substantially coextensive with the arcuate periphery of said bowed-in portion.

6. A contact member according to claim 1, characterized in that the base is formed with an arcuate cross section dimple protruding into the channel and which is aligned with said bowed portions and merges therewith, so that the contact member is smoothly U-shaped as seen in cross section through said bowed portions.

7. A contact member according to claim 1, characterized in that the side walls are formed with at least one pair of opposed flanges projecting into the channel and having insulation severing edge surfaces which converge from the side walls, at positions remote from the base, towards the base, and adjoin substantially parallel, core-gripping edge surfaces of said flanges which extend substantially normally of the base, to define an auxiliary core-receiving slot.

* * * * *